US005605374A

United States Patent [19]

Perry

[11] Patent Number: 5,605,374

[45] Date of Patent: Feb. 25, 1997

[54] ADJUSTABLE PADDED ARM REST

[76] Inventor: Mary O. Perry, 144 Santee Dr., Panama City, Fla. 32404

[21] Appl. No.: 502,963

[22] Filed: Jul. 17, 1995

Related U.S. Application Data

[63] Continuation-in-part of Ser. No. 29,078, Sep. 29, 1994, and a continuation-in-part of Ser. No. 334,047, Nov. 4, 1994.

[51] Int. Cl.[6] ..... A47C 31/02

[52] U.S. Cl. ..... 297/227; 297/411.23; 297/228.12

[58] Field of Search ..... 297/219.1, 220, 297/227, 411.21, 411.23, DIG. 6, 218.3, 225, 228.12; 5/663, 490; 248/345.1

[56] References Cited

U.S. PATENT DOCUMENTS

| | | | |
|---|---|---|---|
| 1,804,841 | 5/1931 | Pedroli | 248/345.1 |
| 2,057,551 | 10/1936 | Bishop | 297/227 |
| 2,600,556 | 6/1952 | Malm | 5/663 |
| 3,136,311 | 6/1964 | Lewis | 297/DIG. 6 X |
| 3,313,511 | 4/1967 | Koerner | 297/DIG. 6 X |
| 3,331,630 | 7/1967 | Harsh | 297/228.12 |
| 4,588,224 | 5/1986 | Hill, Jr. | 297/DIG. 6 X |
| 5,193,238 | 3/1993 | Clute | 5/490 |
| 5,332,288 | 7/1994 | Coates | 297/227 X |

*Primary Examiner*—Peter M. Cuomo
*Assistant Examiner*—David E. Allred
*Attorney, Agent, or Firm*—George A. Bode; Daniel E. Maddux

[57] ABSTRACT

An adjustable padded arm rest cushion for removable attachment to the arm of a chair is disclosed. The cushion comprises: a sack having a foam cushion therein, the sack being closed by stitching around its perimeter, thereby defining a pair of opposing marginal side edges; and, a pair of elongated rings, a pair of short bands securing the elongated rings to one of the opposing side edges of the sack, and a second pair of longer bands attached to the opposing side edge opposite the short bands, the long bands have hook and loop fasteners on one surface such that when the long bands are inserted through the elongated rings and folded back upon themselves, the fasteners secure the long bands in place and secure the sack to the arm of the chair. The bottom of the sack is split down its middle into two overlapping portions of about equal size to allow the pad to be easily removed from and inserted into the sack.

11 Claims, 3 Drawing Sheets

ADJUSTABLE PADDED ARM REST

This application is a continuation-in-part application of previous applications by the same inventor bearing U.S. Ser. No. 29/029,078, filed Sep. 29, 1994; Ser. No. 08/334,047, filed Nov. 4, 1994; and a design application executed Jun. 12, 1995, and entitled "Adjustable Padded Arm Rest" now Ser. No. 29/040,432, filed Jun. 19, 1995. The entire previous applications Ser. No. 29/029,078; Ser. No. 08/334,047; and Ser. No. 29/040,432 are incorporated herein by reference as if set forth in full below.

BACKGROUND OF THE INVENTION

1. Field of the Invention

The present invention relates to cushions and more particularly, to a cushion which is removably securable to the arm of a chair so that a person sitting therein can comfortably rest his arm on the arm of the chair, particularly during extended periods at a work station.

2. General Background

It is well known to employ cushions for comfort when a person rests against a surface be it a chair or table. However, in modern day office situations, a person is often working at a work station, such as a computer terminal, seated for hours and must lean his arms on the arms of a chair. These arms are designed to support the forearms of a person resting and are too low to adequately support the forearms of a person working. In particular, these arms are too low to adequately support the forearms of a person working at a work station. Because chair arms are positioned too low to adequately support the forearms of a person working at a work station, persons sitting in the chairs while working for long periods of time experience fatigue and undue stress on their shoulders and forearms. Such fatigue and undue stress can result in: anterior weight bearing, thoracic outlet syndrome, myofascitis and several of the entrapment neuropathies of the upper extremities; all of which decrease worker productivity and result in increased medical expenses and sick leave for the employee. These problems are particularly acute for persons working in a repetitive work environment, such as a computer operator or directory assistance operator.

Keyboard supports for computer operators are known in the prior art. However, these supports only address the support necessary for the outer most extremities of the forearm. Furthermore, these supports are sufficient for persons working only one (1) or two (2) hours at a work station. For persons working longer periods of time, additional anterior support is needed.

Thus, a need exists for an apparatus that is attached to the arm of a chair and which relieves and/or prevents fatigue and undue stress on the shoulders and forearms of persons working at a work station for long hours while sitting in a chair.

A need also exists for an apparatus with the above features which can be removably secured to the arm of the chair.

A need also exists for an apparatus with the above features which is adjustable to fully encircle chair arms of different sizes.

A need also exists for an apparatus with the above features which is made of a soft and washable material so that it can be removed from the arm after use, washed and then refitted to the arm.

A need also exists for an apparatus with the above features which will increase worker productivity and reduce sick leave and medical claims for persons working in a repetitive work environment while sitting in a chair.

A need also exists for an apparatus with the above features which is simple in design and easy and economical to manufacture.

SUMMARY OF THE PRESENT INVENTION

The preferred embodiment of the apparatus of the present invention solves the aforementioned problems in a straightforward and simple manner. What is provided is an adjustable padded arm rest cushion for removable attachment to the arm of a chair, comprising: a sack having a pad therein, the sack being closed by stitching around its perimeter to define opposing marginal side edges; and means for securing the sack to the arm of the chair. The securing means is attached to opposing marginal side edges of the sack. The securing means can comprise a pair of elongated rings each secured to one of a pair of short bands or flaps looped through one of the elongated rings and stitched to one of the opposing marginal side edges of the sack, and, a pair of elongated bands or flaps each of which is stitched at its proximate end to the other of the opposing marginal side edges of the sack, each elongated flap having fastening means on one surface thereof, such that when an elongated flap is inserted through a corresponding elongated ring and folded over the ring, the elongated flap is fastened to itself.

In operation, the cushion is placed on the arm of a chair such that the securing means is extended from the marginal side edges of the cushion. The securing means is inserted under the arm of the chair and joined as described to secure the cushion to the arm.

Therefore, it is an object of the present invention to provide an arm rest cushion for the arms of a chair which relieves and/or prevents fatigue and undue stress on the shoulders and forearms of persons working at a work station for long hours while sitting in a chair.

It is a further object of the present invention to provide an arm rest cushion that will be removably secured to the arm of the chair.

It is a further object of the present invention to make the arm rest cushion adjustable to fully encircle arms of different sizes.

It is another object of the present invention to make such an arm rest cushion of a soft and washable material so that it can be removed from the arm after use, washed and then refitted to the arm.

It is another object of the present invention to make such an arm rest cushion which will increase worker productivity and reduce sick leave and medical claims for persons working in a repetitive work environment while sitting in a chair.

It is a further object of the present invention to make such an arm rest cushion which is simple in design and easy and economical to manufacture.

These and other objects and advantages of this invention will become obvious upon further investigation of the accompanying drawing and detailed description.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
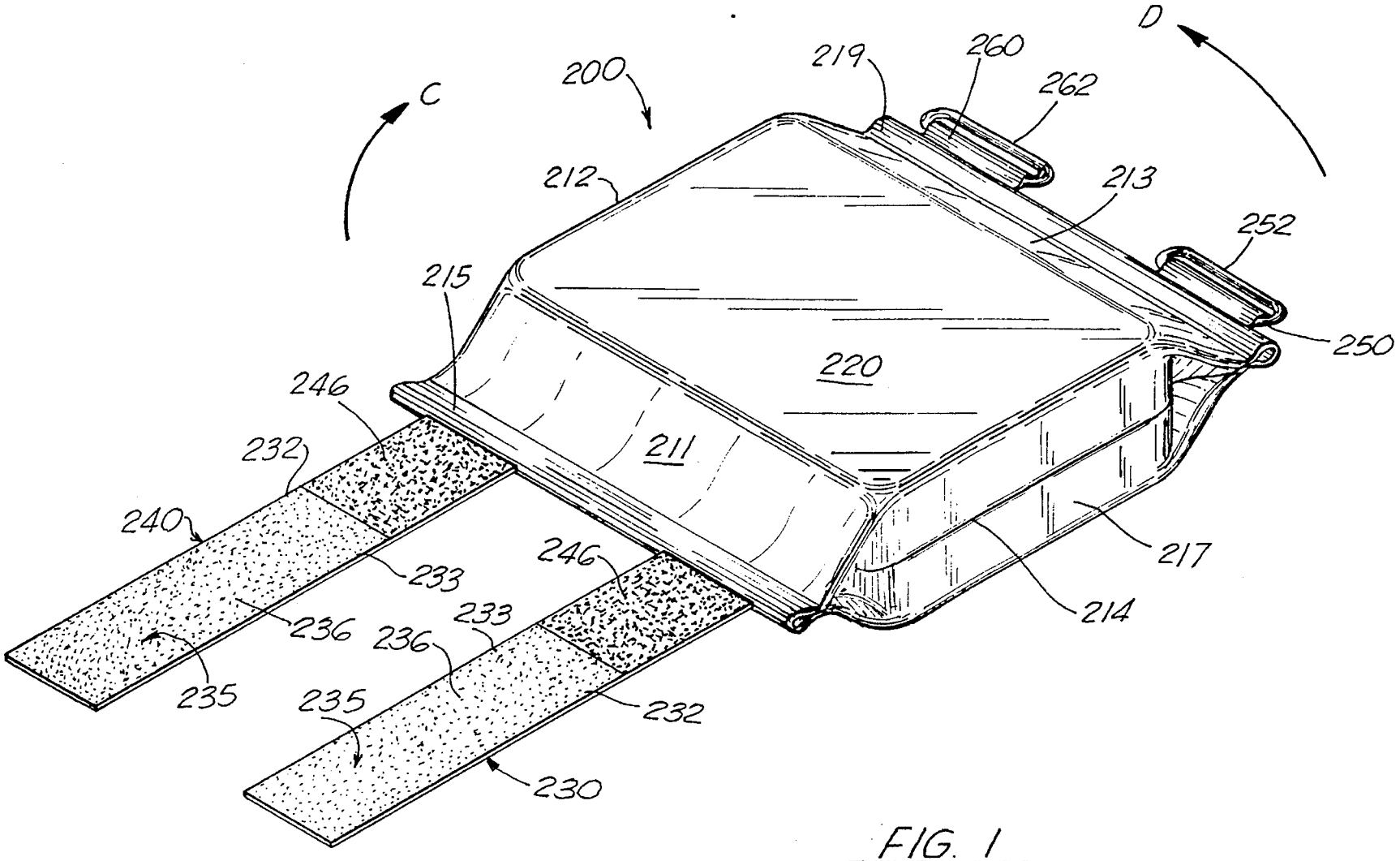
FIG. 1 is a top, front and right side perspective view of the preferred embodiment of the apparatus of the present invention.
Figure 2:
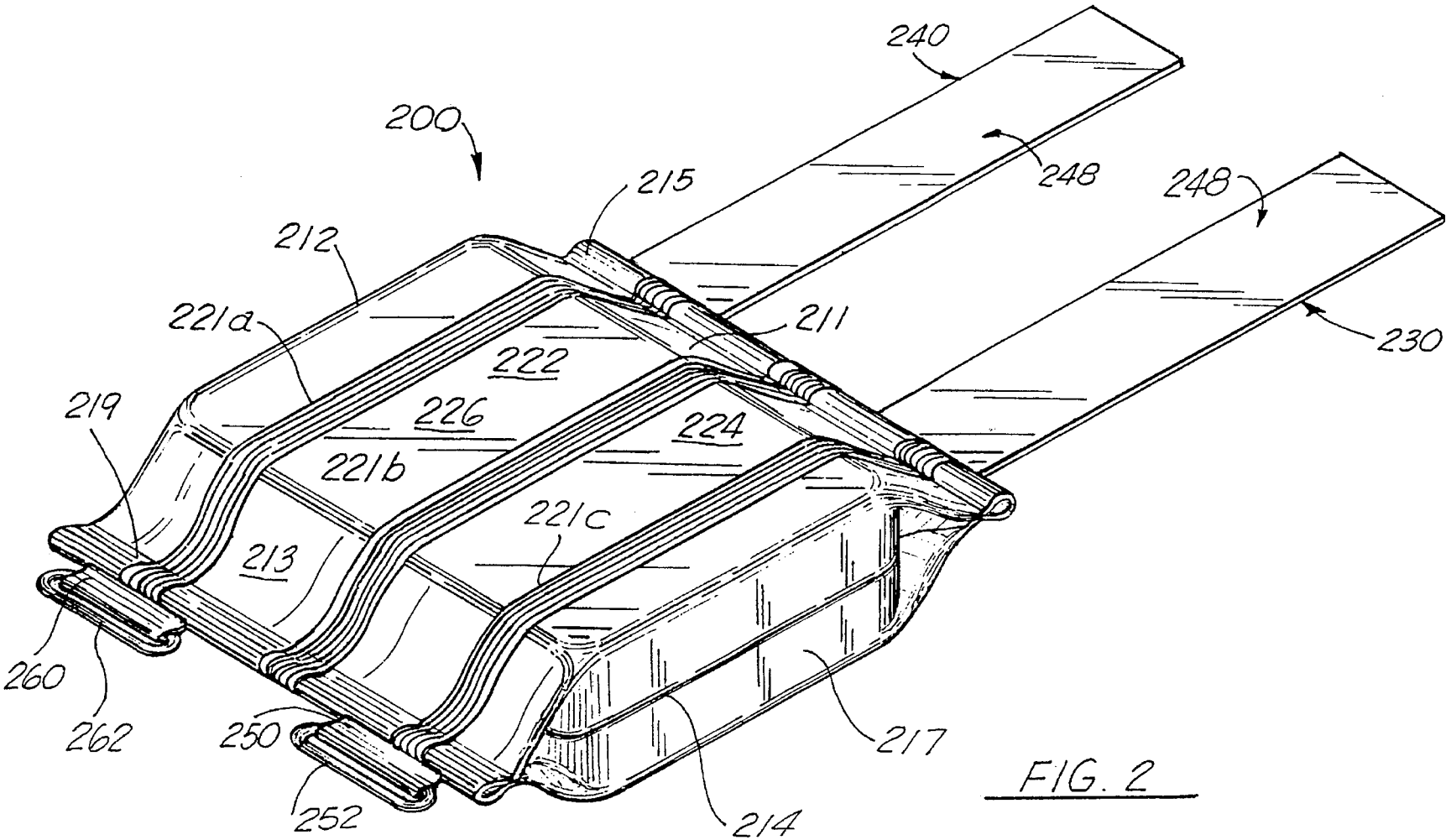
FIG. 2 is a bottom, rear and right side perspective view of the embodiment of FIG. 1.
Figure 3:
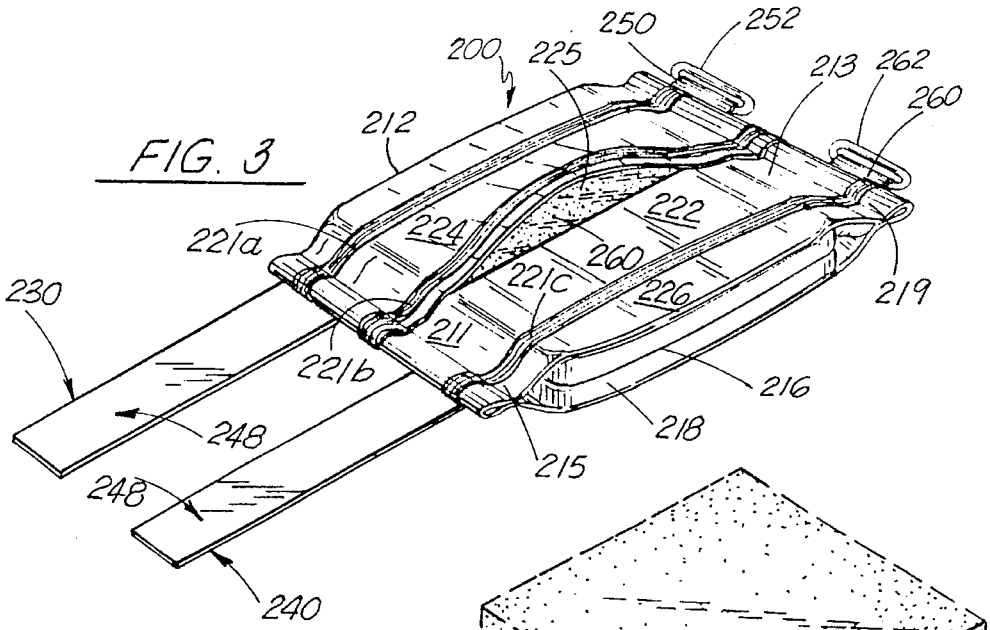
FIG. 3 is a bottom, front and left side perspective view of the embodiment of FIG. 1, illustrating the sack in its "open" condition to allow insertion of foam padding into the sack.
Figure 4:
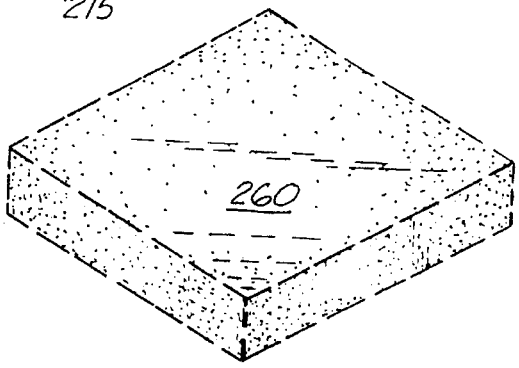
FIG. 4 is a perspective view of the padding (in broken lines) of FIG. 3, removed from the sack; and, FIG. 5 is a top and right side perspective view of the embodiment of FIG. 1, the broken lines showing a wheelchair to illustrate one application of the present invention.

Referring to FIGS. 1–5, and FIGS. 1–3 in particular, the preferred embodiment of the present invention is disclosed. Adjustable padded arm rest cushion 200 is comprised of closed sack 212 having provided therein foam cushion 260 (as best seen in FIGS. 3 and 4). Cushion 200 in its expanded or inflated condition takes the form of FIGS. 1–3. Sack 212 is closed by stitching 214 and 216 along right and left sides 217 and 218, respectively, and stitching 215 and 219 along front and rear marginal side edges 211 and 213, respectively, thus defining top surface 220 and bottom surface 222. (The position of FIG. 2 is obtained by rotating or flipping cushion 200 of FIG. 1 by 180° in the direction of ARROW C or about the lateral axis. The position of FIG. 3 is obtained by rotating or flipping cushion 200 of FIG. 1 by 180° in the direction of ARROW D or about the longitudinal axis.)

Stitching 215 attaches the marginal edges of the proximate ends of longitudinally disposed elongated bands or flaps 230 and 240 to the front marginal side edge 211 of sack 212, and stitching 219 attaches both the proximate and distal ends of longitudinally disposed short bands or flaps 250 and 260 to rear marginal edge 213 of sack 212, thereby forming closed loops.

Elongated flaps 230 and 240 have smooth surfaces 248 on the bottom side thereof and fastening means or surfaces 235 on the opposite or top side thereof. Fastening means or surfaces 235 have mating surfaces of the hook and loop type fastener or VELCRO. Fastening means or surfaces 235 are divided into hook or male surface portions 236 and loop or female surface portions 246. Preferably, fastening means or surfaces 235 are divided such that about 60% of fastening means or surfaces 235 are hook surface portions 236 and about 40% of fastening means or surfaces 235 are loop surface portions 246. Also preferable is that elongated flaps 230 and 240 are about the same length as the length of cushion 200. Elongated flaps 230 and 240 are substantially rectangular in shape and have outwardly facing marginal side edges 232 and inwardly facing marginal side edges 233.

Short flaps 250 and 260 are inserted through elongated rings 252 and 262, respectively, then folded back and attached at both their proximate and distal ends to sack 212 with stitching 219 to form the closed loops which hold elongated rings 252 and 262, respectively, in place. Together, short flaps 250 and 260, elongated rings 252 and 262, and long flaps 230 and 240 and surfaces 235 form a means for securing sack 212 to the arm of a chair, be it a conventional arm chair as shown in FIG. 3 of parent application Ser. No. 08/334,047 or the wheelchair of FIG. 5.

As best seen in FIGS. 2 and 3, bottom surface 222 of sack 212 has three spaced apart longitudinal ribs or linings 221 stitched thereon, one of which runs longitudinally down the center of bottom surface 222. Thus, bottom surface 222 is divided into overlapping bottom portions 224 and 226 of about equal length. Bottom portion 224 overlaps portion 226 at mid-rib **221*b*. Fastening means portion or surface 225 is attached to the underside of bottom portion 224 at the marginal edge thereof. Fastening means portion 225 is preferably a strip of hook type fastener or VELCRO of about the same length and width as lining 221*b*. Fastening means 225 engages bottom portion 226 which is of the fabric or loop type fastener, thereby sealing bottom surface 222. Bottom surface 222 is opened by pulling overlapping bottom portion 224 away from bottom portion 226, as best seen in FIG. 3. Thus foam cushion 260 can be easily removed from sack 212** and cleaned or replaced.

Figure 5:
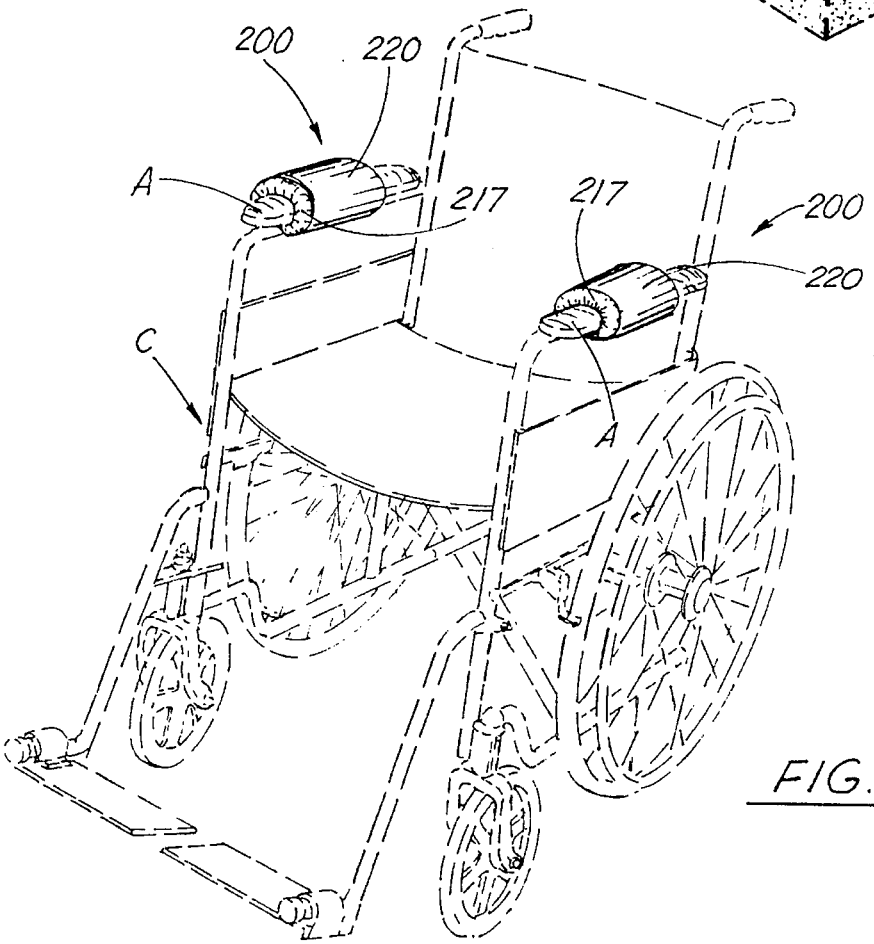

In operation bottom surface 222 is placed on either or both arms A of wheelchair C (in phantom), as best seen in FIG. 5. Elongated flaps 230 and 240 are inserted under arms A, through elongated rings 252 and 262, respectively, and then folded back against themselves such that hook-type surfaces 236 engage loop-type surfaces 246 of fastening means or surfaces 235, thereby securing cushions 200 to arms A of wheelchair C. As can be seen from FIG. 5, cushion 200 is removably secured to arms A of wheelchair C. To remove cushion 200 from arms A of wheelchair C, long flaps 230 and 240 are pulled apart such that hook-type surfaces 236 disengage loop-type surfaces 246 of fastening means or surfaces 235, and elongated flaps 230 and 240 are removed from elongated rings 252 and 262, respectively.

Cushion 200 provides additional anterior support for the forearms of a person sitting in wheelchair C, as best seen in FIG. 5, thus relieving and/or preventing fatigue and undue stress on the shoulders and forearms of persons working at a work station for long hours while sitting in wheelchair C. Cushion 200, by preventing and/or relieving fatigue and undue stress, increases worker productivity and reduces sick leave and medical claims for persons working in such a repetitive work environment while sitting in a chair.

As can be seen from FIGS. 1–3, long flaps 230 and 240 are adjustable to fully encircle chair arms of different sizes.

Cushion 200 is made of a soft and washable cloth material so that it can be removed from the arm of a chair after use, washed and then refitted to the arm.

As can be seen from the drawing, the apparatus of the present invention is simple in design and easy and economical to manufacture.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A cushion for removable attachment to the arm of a chair, the cushion comprising:

(a) a sack having a foam cushion therein, said sack being closed by stitching around its perimeter, thereby defining a pair of opposing marginal side edges, said sack having a top and a bottom, said bottom being selectively severable at its center into two portions of substantially equal length such that one of said portions longitudinally overlaps the other of said portions, said bottom being so severable into said two portions to allow for the removal and insertion of said foam cushion from and into said sack; and, (b) means for removably securing said sack around said arm of a chair, said securing means being attached to said pair of opposing marginal side edges of said sack, said securing means including:

(i) a pair of elongated rings;

(ii) a first pair of bands, each of said bands being looped through a respective one of said elongated rings and fixedly attached at both ends thereof to one of said opposing marginal side edges of said sack to thereby form a closed loop, thereby securing said elongated rings to said one of said opposing marginal side edges of said sack; and, (iii) a second pair of bands, longer than said first pair, each attached at one of its ends to the other of said opposing marginal side edges of said sack, each of said second bands having fastening means on one surface thereof, whereby when said second bands are each inserted through a respective one of said elongated rings and folded back on itself, said fastening means secure each of said second bands to itself.

2. The cushion of claim 1, wherein said sack is made of a cloth material.

3. The cushion of claim 1, wherein said securing means are adjustable to fully encircle chair arms of different sizes.

4. The cushion of claim 1, wherein said fastening means are hook and loop type fasteners and said surfaces of said second bands containing said fastening means are each divided whereby a first portion of said surfaces are hook type fasteners and a second portion of said surfaces are loop type fasteners.

5. The cushion of claim 1, wherein said surfaces containing said loop type fasteners are adjacent to said one of said opposing marginal side edges of said sack.

6. The cushion of claim 1, wherein the length of said second bands is substantially the same as the length of said sack.

7. The cushion of claim 1, wherein said overlapping portions have hook and loop type fasteners stitched thereto, whereby when said overlapping portions are pressed against each other, said hook type fasteners engage said loop type fasteners to securely seal said foam cushion in said sack.

8. A cushion for removable attachment to the arm of a chair, the cushion comprising:

(a) a sack made of a cloth material and having a foam cushion therein, said sack being closed by stitching around its perimeter, thereby defining a substantially rectangular member having a pair of opposing marginal side edges, said sack having a top and a bottom, said bottom being selectively severable at its center into two portions of substantially equal length such that one of said portions longitudinally overlaps the other of said portions, said bottom being so severable into said two portions to allow for the removal and insertion of said foam cushion from and into said sack; and, (b) means for removably securing said sack around said arm of a chair, said securing means being attached to said pair of opposing marginal side edges of said sack, said securing means including:

(i) a pair of elongated rings;

(ii) a first pair of bands, each of said bands being looped through a respective one of said elongated rings and fixedly attached at both ends thereof to one of said opposing marginal side edges of said sack to thereby form a closed loop, thereby securing said elongated rings to said one of said opposing marginal side edges of said sack; and, (iii) a second pair of bands, longer than said first pair, each attached at one of its ends to the other of said opposing marginal side edges of said sack, each of said second bands having fastening means on one surface thereof, whereby when said second bands are each inserted through a respective one of said elongated rings and folded back on itself, said fastening means secure each of said second bands to itself.

9. The cushion of claim 8, wherein:

(a) said fastening means are hook and loop type fasteners;

(b) said surface of said second bands containing said fastening means divided whereby a first portion of said surfaces are hook type fasteners and a second portion of said surfaces are loop type fasteners;

(c) said surfaces containing said loop type fasteners being adjacent to said one of said opposing marginal side edges of said sack; and, (d) the length of said second bands is substantially the same as the length of said sack.

10. The cushion of claim 8, wherein:

said overlapping portions have hook and loop type fasteners stitched thereto, whereby when said overlapping portions are pressed against each other, said hook type fasteners engage said loop type fasteners to securely seal said foam cushion in said sack.

11. An adjustable arm rest cushion for removable attachment to the arm of a chair, the cushion comprising:

(a) a sack made of a cloth material and having a foam cushion therein, said sack being closed by stitching around its perimeter, thereby defining a substantially rectangular member having a pair of opposing marginal side edges, said sack having a top and a bottom, said bottom being selectively severable at its center into two portions of substantially equal length such that one of said portions longitudinally overlaps the other of said portions, said bottom being so severable into said two portions to allow for the removal and insertion of said foam cushion from and into said sack and said overlapping portions have hook and loop type fasteners stitched thereto, whereby when said overlapping portions are pressed against each other, said hook type fasteners engage said loop type fasteners to securely seal said foam cushion in said sack; and, (b) means for removably securing said sack around said arm of a chair, said securing means being attached to said pair of opposing marginal side edges of said sack, said securing means being adjustable to fully encircle chair arms of different sizes, said securing means including:

i. a pair of elongated rings;

ii. a first pair of bands, each of said bands being looped through a respective one of said elongated rings and fixedly attached at both ends thereof to one of said opposing marginal side edges of said sack to thereby form a closed loop, thereby securing said elongated rings to said one of said marginal side edges of said sack; and, iii. a second pair of bands, longer than said first pair, each attached at one of its ends to the other of said opposing marginal side edges of said sack, each of said second bands having fastening means on one surface thereof, whereby when said second bands are each inserted through a respective one of said elongated rings and folded back on itself, said fastening means secure each of said second bands to itself, said second bands being adjustable to fully encircle chair arms of different sizes, said fastening means being hook and loop type fasteners and said surfaces of said second bands containing said fastening means and being is divided whereby a first portion of said surfaces are hook type fasteners and a second portion of said surfaces are loop type fasteners, said surfaces containing said loop type fasteners being adjacent to said one of said opposing marginal side edges of said sack.

* * * * *